US006401301B1

(12) United States Patent
Hung

(10) Patent No.: US 6,401,301 B1
(45) Date of Patent: Jun. 11, 2002

(54) SCREWDRIVER GRIP STRUCTURE

(76) Inventor: Kun Chih Hung, No. 56, Shin Ren 3rd Street, Ta Li City, Taichung Hsien (TW)

( * ) Notice: Subject to any disclaimer, the term of this patent is extended or adjusted under 35 U.S.C. 154(b) by 43 days.

(21) Appl. No.: 09/657,188

(22) Filed: Sep. 7, 2000

(51) Int. Cl.[7] ..... B25B 15/04

(52) U.S. Cl. ..... 16/430; 16/900; 81/58.5; 81/90.1; 81/90.9

(58) Field of Search ..... 16/430, 436, 111.1, 16/900; 81/58.5, 90.1, 90.9, 91.1, 177.1, 177.2, 177.7, 177.8, 901, 52, 177.9

(56) References Cited

U.S. PATENT DOCUMENTS 2,182,673 A * 12/1939 Magnano ..... 81/436
4,825,734 A * 5/1989 Schwalbe et al. ..... 81/177.9
5,142,953 A * 9/1992 Lin ..... 81/63
5,515,754 A * 5/1996 Elkins ..... 81/177.9
5,927,162 A * 7/1999 Huang ..... 81/177.8
5,943,921 A * 8/1999 Lin ..... 81/177.7
6,116,123 A * 9/2000 Chen ..... 81/177.2
6,189,420 B1 * 2/2001 Shiao ..... 81/177.9
6,216,317 B1 * 4/2001 Chen ..... 16/430

* cited by examiner

*Primary Examiner*—Lynne H. Browne
*Assistant Examiner*—Doug Hutton
(74) *Attorney, Agent, or Firm*—Rosenberg, Klein & Lee

(57) ABSTRACT

A screwdriver grip including a tool section, a connecting section and a grip. A front end of the tool section is disposed with a working section and a rear end of the tool section is formed with a pivot section pivotally connected with a pivot cavity of the connecting section, whereby the tool section can be pivotally rotated relative to the connecting section. The grip is back and forth sliably fitted on the connecting section. A locating member is disposed between the connecting section and the grip. When the grip is moved forward or rearward to a certain position, the locating member fixedly locates the grip on the connecting section. The grip can be moved rearward and the connecting section can be pivotally rotated by a certain angle for a user to easily hold the grip. Alternatively, the grip can be moved forward to shorten the length of the screwdriver.

3 Claims, 7 Drawing Sheets

SCREWDRIVER GRIP STRUCTURE

BACKGROUND OF THE INVENTION

The present invention relates to an improved screwdriver grip structure which is telescopic for easy carriage. In addition, the grip can be pivotally rotated to change the angle of the grip for easily holding the grip and facilitating application of force to the grip as well as preventing a user's wrist from getting hurt.

FIG. 7 shows the use of a conventional screwdriver. The axis of the grip coincides with the rotational axis of the screwdriver. Therefore, when a user holds the grip, the axis of the arm and the axis of the rotational axis of the screwdriver contain an angle. In order to smoothly rotate the screwdriver, the user often will curve his wrist to make the axis of the arm closer to the rotational axis of the screwdriver. However, it necessitates great strength for the palm to rotate the screwdriver. Therefore, the curved wrist is subject to injury.

Moreover, the screwdrivers can be substantially divided into long stem type and short stem type. The screwdriver with long stem is used on those situations necessitating greater rotational torque. Reversely, the short stem screwdriver can be conveniently carried and is used on those situations needing smaller rotational torque.

The long stem screwdriver enables a user to exert a greater torque onto a screw for easily driving the same. However, it is inconvenient to carry the long stem screwdriver. Reversely, the short stem screwdriver can be conveniently carried and stored. However, it is hard for a user to hold and use the short stem screwdriver with greater torque.

SUMMARY OF THE INVENTION

It is therefore a primary object of the present invention to provide a screwdriver grip structure in which the tool section and the connecting section are pivotally connected and rotatable relative to each other. A locating member is disposed in a passage of the connecting section. A press section of the locating member is engaged in any of the locating holes of the grip so as to locate the grip. When the press section of the locating member is pressed down and sunk into the connecting section, the grip can be moved forward to shorten the total length of the screwdriver for easy carriage and storage. Alternatively, the grip can be moved rearward to increase the total length and the connecting section can be pivotally rotated so that the screwdriver can be conveniently used, while preventing the wrist from getting hurt.

The present invention can be best understood through the following description and accompanying drawings wherein:

DETAILED DESCRIPTION OF THE PREFERRED EMBODIMENT

Figure 1:
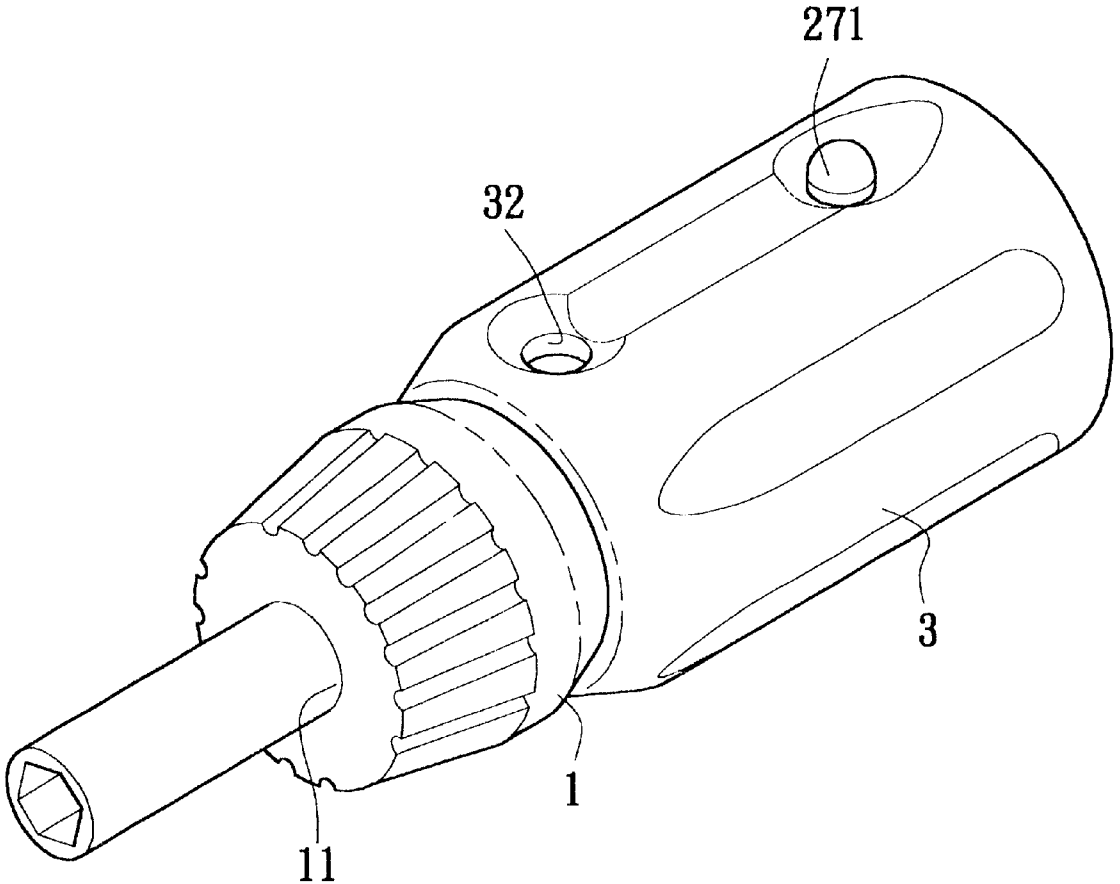
FIG. 1 is a perspective assembled view of the present invention.
Figure 2:
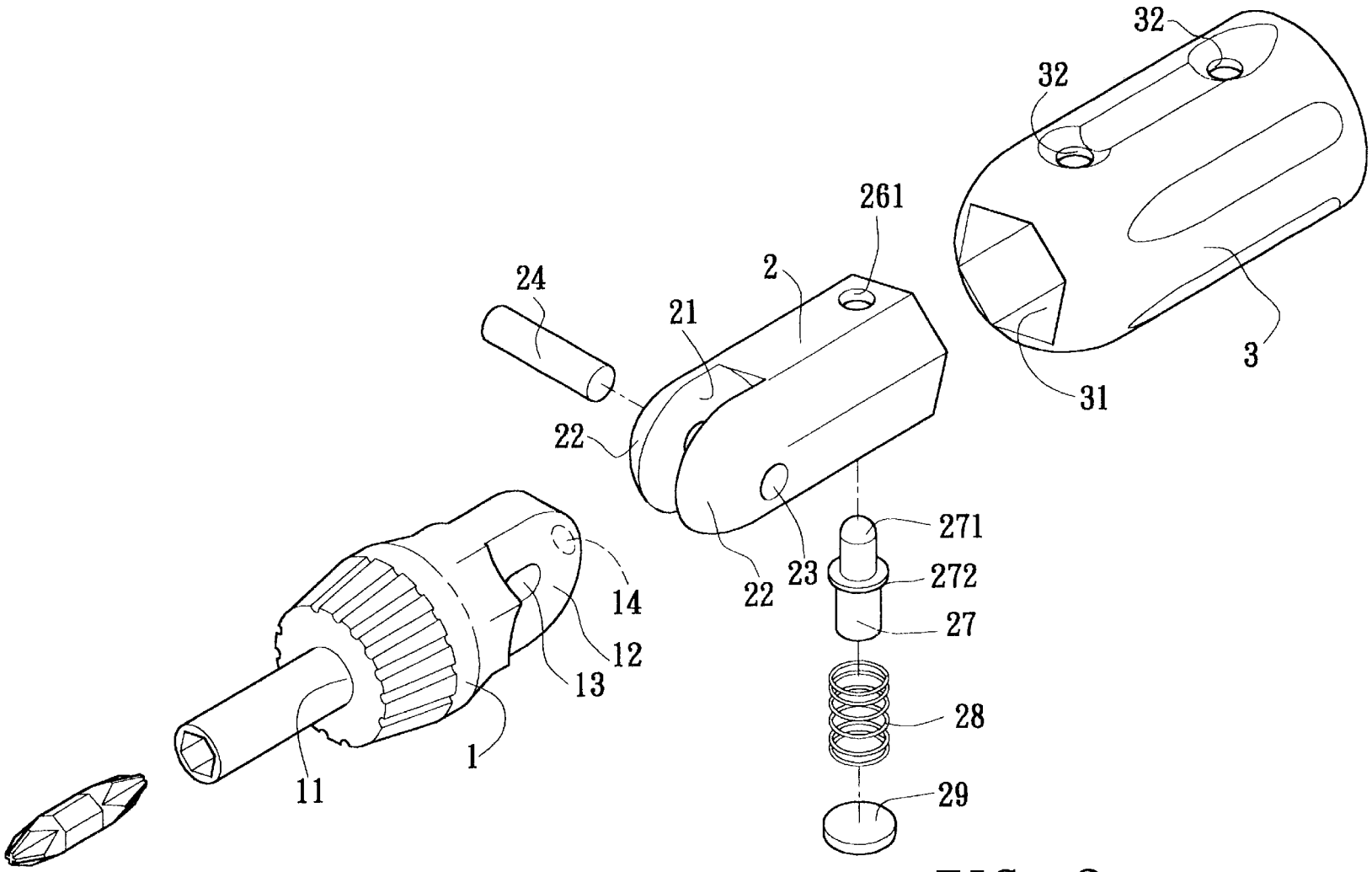
FIG. 2 is a perspective exploded view of the present invention.
Figure 3:
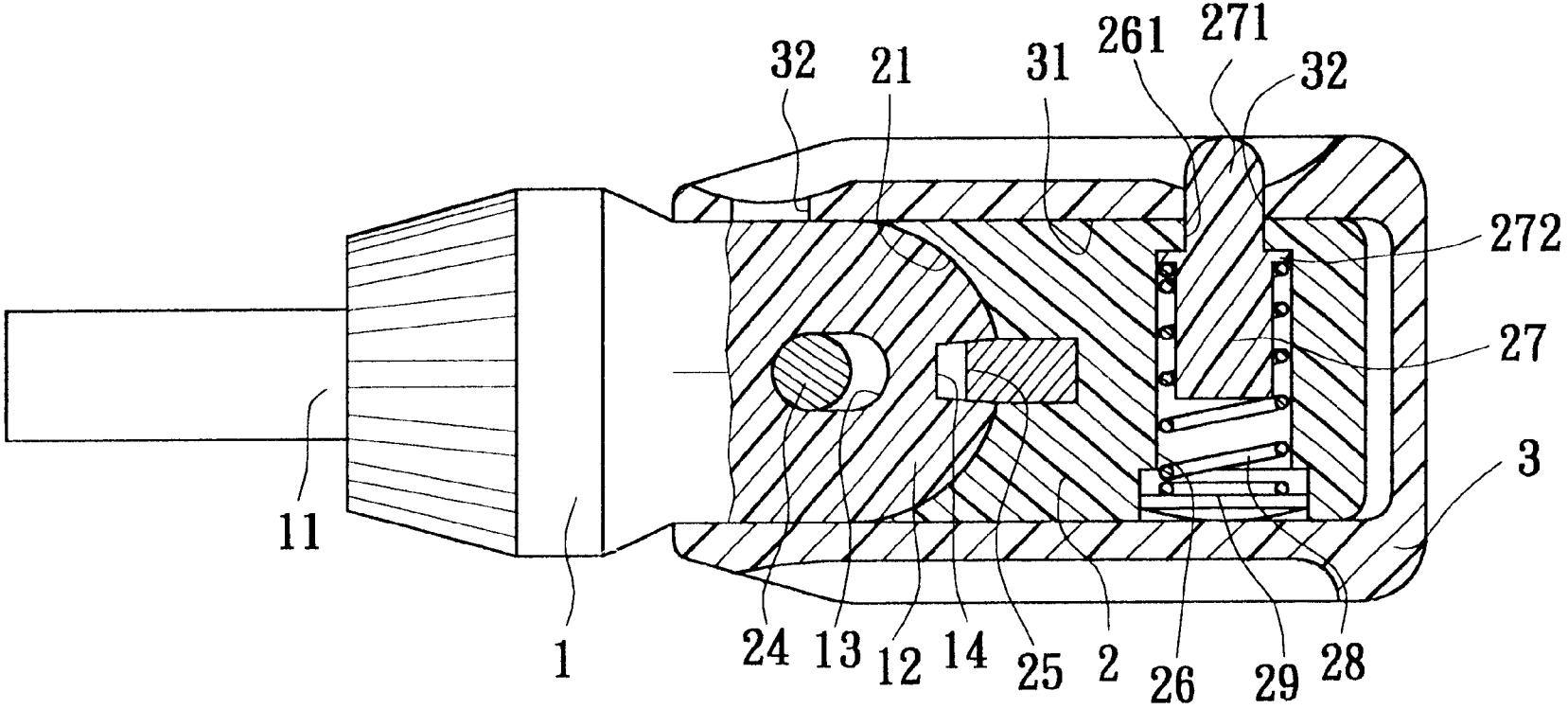
FIG. 3 is a sectional view taken along line lll—lll of FIG. 1.

Please refer to FIGS. 1 to 3. The screwdriver grip structure of the present invention includes:

a tool section 1, a front end of the tool section 1 being disposed with a working section 11, while a rear end of the tool section 1 being formed with a pivot section 12, the pivot section 12 being formed with a central slot 13, a center of rear edge of the pivot section being formed with an engaging socket 14;

a connecting section 2 having a hexagonal cross-section, a front of the connecting section 2 being formed with a pivot cavity 21, two sides of the pivot cavity being respectively disposed with two lugs 22, each lug 22 being formed with a shaft hole 23, whereby when the pivot section 12 is pivotally connected with the pivot cavity 21, a shaft 24 is passed through the shaft holes 23 and the slot 13, the pivot cavity 21 being disposed with a projecting post 25 corresponding to the engaging socket 14 of the pivot section 12, a rear section of the connecting section 2 being formed with a radial passage 26 in which a locating member 27 is received, a spring 28 being disposed under the locating member 27 for upward pushing the locating member 27 in normal state, a base board 29 being disposed under the spring 28, one end of the passage 26 having a small diameter section defining an opening, the locating member 27 having a press section 271 which can protrude out of the small diameter section 261, a middle portion of the locating member 27 being formed with a stop section 272 which is stopped by a shoulder section between the passage 26 and the small diameter section 261 thereof; and a grip 3 having a hollow section 31 with a shape complementary to the shape of the cross-section of the connecting section 2. The grip 3 is back and forth slidably fitted with the connecting section 2 without rotation relative thereto. The grip 3 is formed with two axially arranged locating holes 32 corresponding to the protruding press section 271 of the locating member 27. When the grip 3 is moved back and forth, the press section 271 of the grip 27 can protrude out of any of the locating holes 32 to be located therein.

Figure 4:
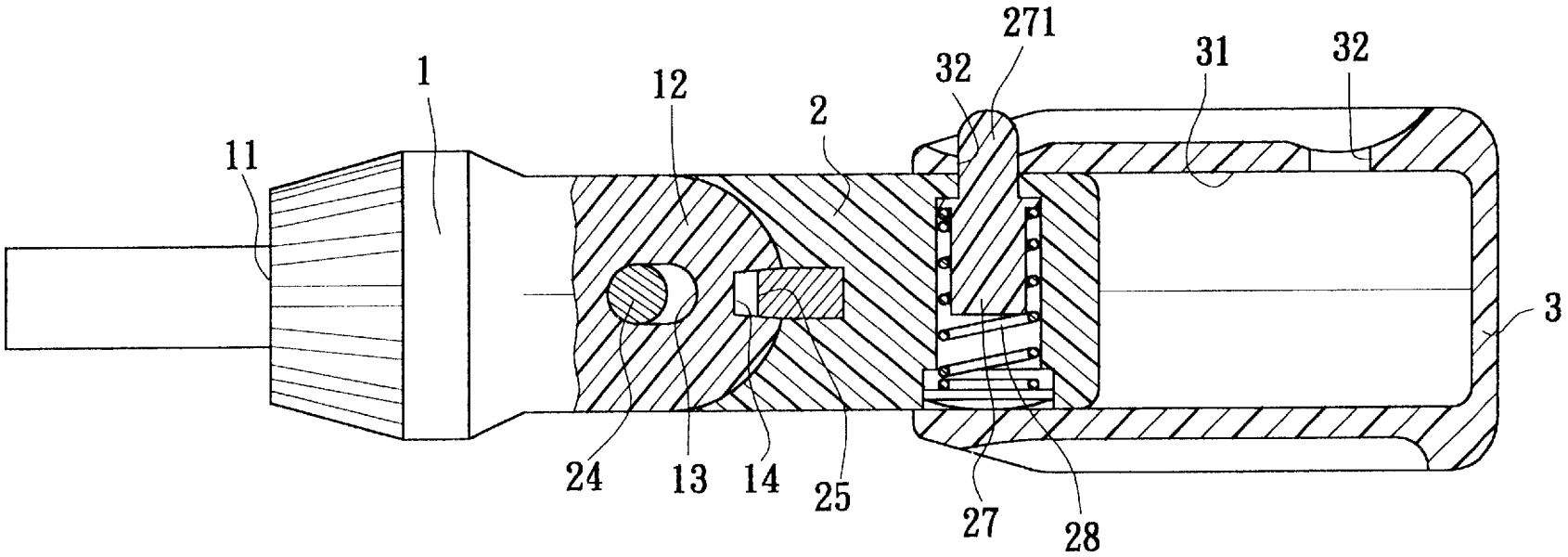
FIG. 4 shows that the grip of the present invention is pulled backward.

In use, a user can press the press section 271 of the locating member 27 and sink the press section 271 into the connecting section 2. Then the grip 3 is pulled backward. Then the locating member 27 is resiliently pushed by the spring 28 to make the press section 271 engaged in the front locating hole 32 of the grip 3 so as to locate the grip 3 as shown in FIG. 4. After the grip 3 is extended, the total length of the screwdriver is increased for the user to conveniently hold the grip 3.

Figure 5:
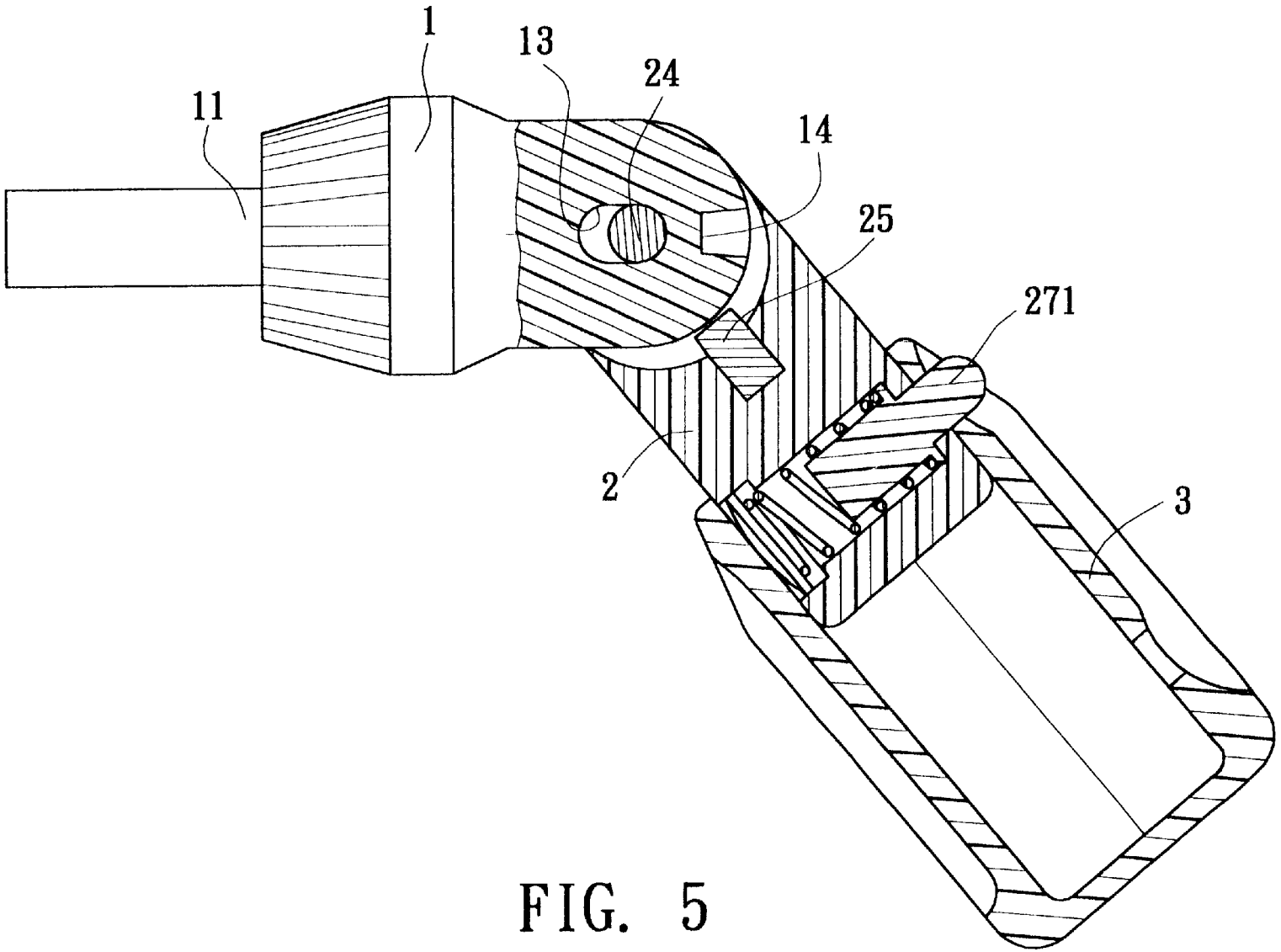
FIG. 5 shows that the connecting section of the present invention is pivotally rotated.
Figure 6:
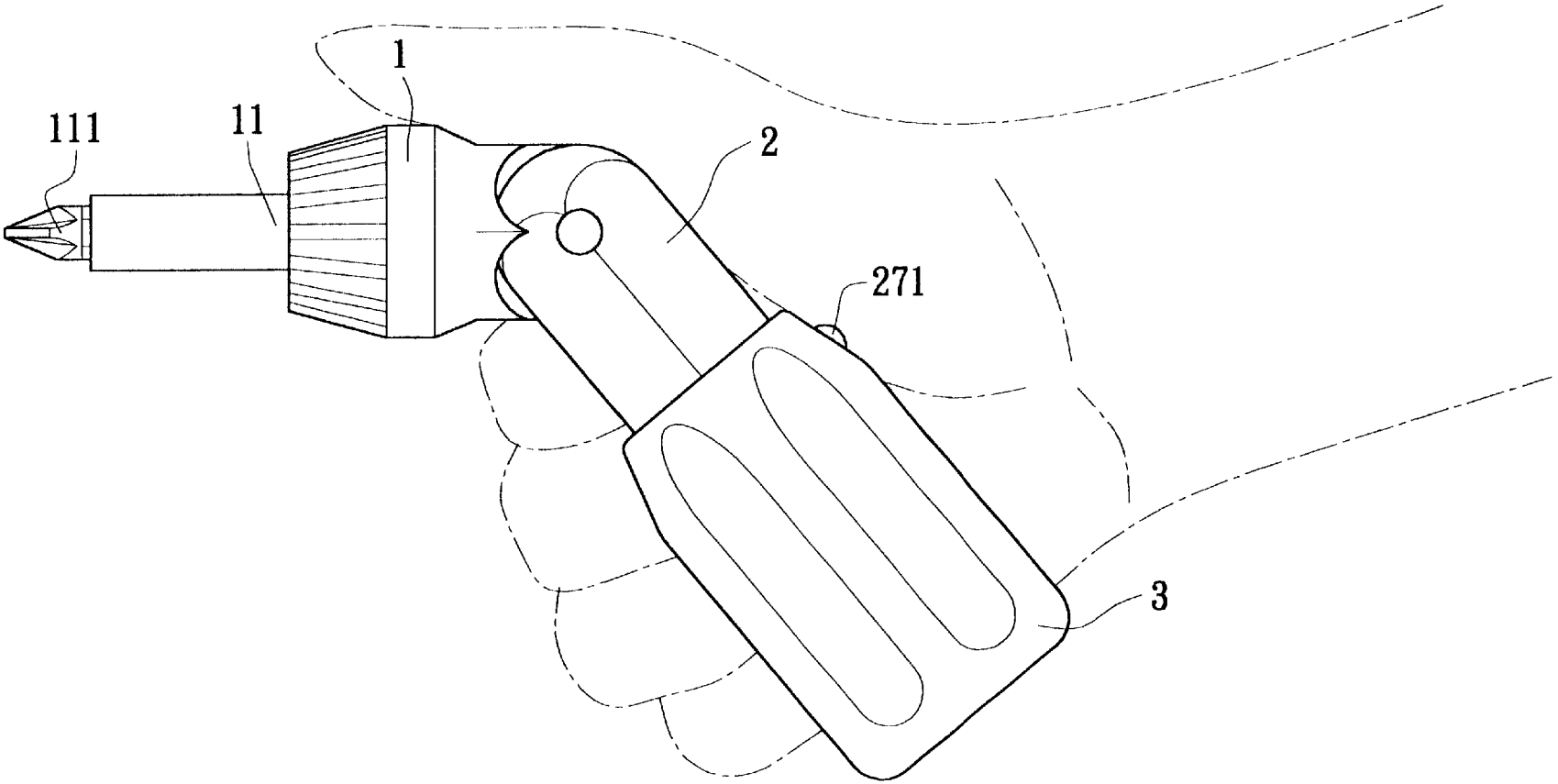
FIG. 6 shows the use of the present invention.
Figure 7:
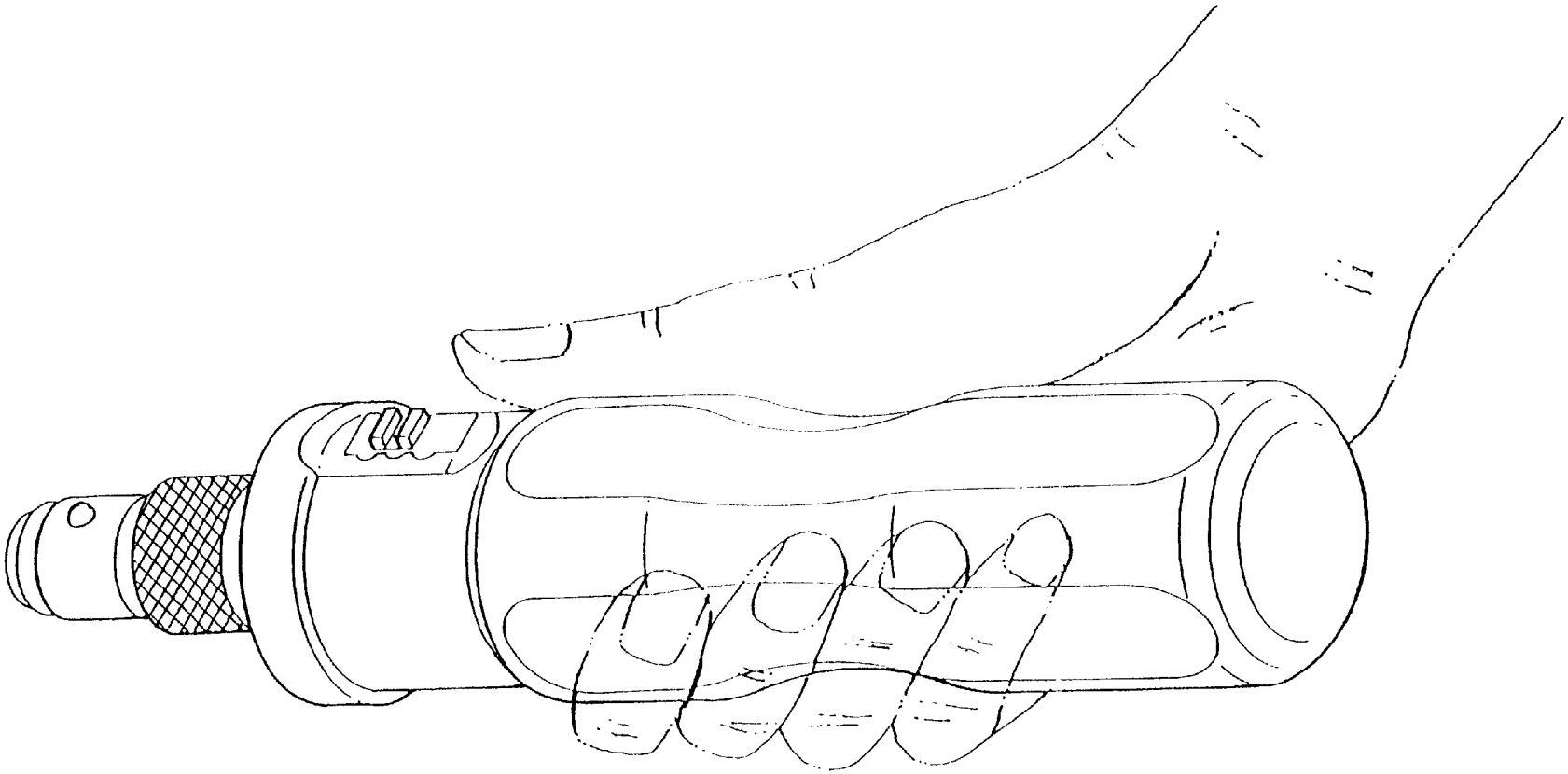
FIG. 7 PRIOR ART
Fig. 7 shows the use of a conventional screwdriver.

When it is necessary to reciprocally rotate the grip 3, the user can pull the grip 3 backward to extract the projecting post 25 of the connecting section 2 from the engaging hole 14 of the tool section 1. At this time, the connecting section 2 can be pivotally rotated to make the tool section 1 and the grip 3 contain a certain angle as shown in FIG. 5. Accordingly, when the user holds the grip 3 to reciprocally rotate the grip 3, the axis of the arm of the user coincides with the rotational axis of the screwdriver as shown in FIG. 6 so that the wrist of the user is not subject to injury. After used, the user can pivotally rotate the connecting section 2 and restore the connecting section 2 to its home position and zero the angle contained between the connecting section and the tool section. Then the press section 271 of the locating member 27 is pressed and sunk into the connecting section 2. Then the grip 3 is pushed forward to make the connecting section 2 nested into the hollow section 31 of the grip 3. Then the spring 28 pushes the locating member 27 and makes the press section 271 thereof engaged in the rear locating hole 32 of the grip 3 so as to locate the grip 3. At this time, the total length of the screwdriver is shortened for easy carriage and storage.

According to the above arrangement, the tool section 1 and the connecting section 2 are pivotally rotatable relative to each other. The press section 271 of the locating member 27 disposed in the passage 26 of the connecting section 2 is engaged in the locating hole 32 of the grip 3 so as to locate the grip 3. When the press section 271 of the locating member 27 is pressed down and sunk into the connecting section 2, the grip 3 can be moved forward to shorten the total length of the screwdriver for easy carriage and storage. Alternatively, the grip 3 can be moved rearward to increase the total length and the connecting section 2 can be pivotally rotated so that the screwdriver can be conveniently used, while preventing the wrist from getting hurt.

The above embodiment is only used to illustrate the present invention, not intended to limit the scope thereof. Many modifications of the above embodiment can be made without departing from the spirit of the present invention.

What is claimed is:

1. A screwdriver grip structure comprising:

a tool section, a front end of the tool section being disposed with a working section, a rear end of the tool section being formed with a pivot section, the pivot section being formed with a central slot;

a connecting section having a non-circular cross-section, a front end of the connecting section being formed with a pivot cavity, two sides of the pivot cavity being respectively disposed with two lugs, each lug being formed with a shaft hole, the pivot section being pivotally connected with the pivot cavity by a shaft rod passed through the shaft holes of the lugs and the central slot of the pivot section, the connecting section having a rear section with a radial passage formed therein; and a grip back and forth slidably fitted on the connecting section, a locating member being disposed between the grip and the connecting section and received in the radial passage of the connection section, whereby when the grip is moved to one of a predetermined front or rear position, the locating member fixedly locates the grip on the connecting section, a spring being disposed under the locating member for upward pushing of the locating member in a normal state, the grip being formed with at least two axially arranged locating holes, the locating member having a press section that protrudes out of the grip through one of the locating holes, whereby when the grip is moved back and forth, the protruding of the press section of the locating member out of a respective one of the locating holes locates the grip with respect to the connecting section.

2. A screwdriver grip structure as claimed in claim 1, wherein one end of the passage has a small diameter section defining an opening, a base board being disposed at the other end of the passage opposite to the opening, the spring being disposed between the base board of the passage and the locating member, a middle portion of the locating member being formed with a stop section which is stopped by a shoulder section between the passage and the small diameter section thereof.

3. A screwdriver grip structure as claimed in claim 1, wherein a center of rear edge of the pivot section is formed with an engaging socket and the pivot cavity of the connecting section is disposed with a projecting post corresponding to the engaging socket of the pivot section.

* * * * *